United States Patent [19]

Ludwig

[11] Patent Number: 4,655,121

[45] Date of Patent: Apr. 7, 1987

[54] CHIMNEY DEFLECTOR HOOD

[75] Inventor: Hans Ludwig, Dreieich, Fed. Rep. of Germany

[73] Assignee: Heinrich Brinkmann Anlagenverpachtung GmbH & Co. KG, Dreieich, Fed. Rep. of Germany

[21] Appl. No.: 800,775

[22] Filed: Nov. 22, 1985

[30] Foreign Application Priority Data

Nov. 22, 1984 [DE] Fed. Rep. of Germany ..... 3442588

[51] Int. Cl.[4] ..... F23L 17/12

[52] U.S. Cl. ..... 98/78; 98/66.1

[58] Field of Search ..... 98/66.1, 67, 78, 79, 98/84

[56] References Cited

U.S. PATENT DOCUMENTS

| | | | |
|---|---|---|---|
| 45,403 | 12/1864 | Geserick | 98/78 |
| 1,097,487 | 5/1914 | Auken | 98/78 |
| 1,986,176 | 1/1935 | Zwerling | 98/78 X |

FOREIGN PATENT DOCUMENTS

| | | | |
|---|---|---|---|
| 7902095 | 9/1980 | Netherlands | 98/78 |
| 26471 | of 1911 | United Kingdom | 98/79 |

*Primary Examiner*—Harold Joyce
*Attorney, Agent, or Firm*—Robert J. Koch

[57] ABSTRACT

Deflector hood for chimneys, in particular for the air exhaust lines of industrial exhaust installations such as digestors or the like, made up of an outer jacket expanding from two opposing openings to a center plane located between the openings. The hood acts as a cap on the air exhaust line. An inner body is held within the outer jacket and expands continuously from the base surface toward the outlet opening. The internal space is open toward the outlet opening and is connected with the environment by a channel leading through the wall of the outer jacket. The inner body has a configuration corresponding to that of the outer jacket, expanding from the inlet opening to a center plane and subsequently narrowing to the outlet opening, such that the annular space enclosed between the outer jacket and the inner body has a cross-sectional area continuously increasing from the inlet cross-section to the outlet cross-section. The channel connecting the internal space of the inner body with the environment and serves to drain off liquids. The channel originates at a lateral surface of the inner body and is in the form of a bearing surface.

4 Claims, 2 Drawing Figures

CHIMNEY DEFLECTOR HOOD

BACKGROUND OF THE INVENTION

1. Field of the Invention

This invention relates to a deflector hood for chimneys, particularly to air exhaust lines of industrial exhaust installations for digestors or the like. The deflector hood is made up of an outer jacket expanding from the two openings to a center plane located between the openings in the form of a cap on the air line and an internal body held in the outer jacket and expanding continuously from the base surface toward the outlet opening. The inner space is open toward the outlet opening and is connected, in the area of the base surface, with the environment by means of a channel passing through the wall of the outer jacket.

2. Description of the Prior Art

Deflector hoods serve to prevent the penetration of rain water into an air exhaust line and thus to protect it against the interference with the air flow. In conventional chimneys this may result in a reduction of the draft or undesirable soot formation. In industrial air exhaust lines, and, in particular, in exhaust lines of digestors, this may result in disturbances varying according to the nature of the installations. Known deflector hoods perform their intended function of preventing penetration of rain, but represent obstacles in the exhaust lines causing an appreciable flow resistance which must be compensated for by either increasing exhaust gas temperature or providing a higher blower capacity.

SUMMARY OF THE INVENTION

It is an object of the present invention to provide a deflector hood with a reduced resistance to exhaust flow. A characteristic of the invention is that an internal body is provided with a configuration expanding toward a center plane and subsequently narrowing in the direction of the exhaust outlet, such that the annular passageway between an outer jacket and the internal body has a cross-sectional area continuously increasing from the inlet cross-section to the outlet cross-section.

The invention provides a deflector hood with diffusor properties offering a flow resistance to the flow medium that is substantially lower than that of the known deflector hoods. The hood according to the present invention has a substantially more compact configuration than that of the known hoods. Investigations showed that the point of reversal wherein the positive static pressure changes to a negative static pressure is located within the hood, so that by means of the deflector hood according to the invention a "pressure recovery" improving the draft of the exhaust line is obtained. It is possible to use blowers with significantly lower capacities in exhaust lines carrying cold gases. In exhaust systems conveying hot gases such as chimneys for boiler installations, the installation may be regulated with substantially lower exhaust gas temperatures. Appreciable energy savings may be achieved with the use of a deflector hood according to the invention.

In an advantageous embodiment of the invention, the liquid exhaust or drain line leading from the internal space of the inner body through the outer wall of the outer jacket may originate at the lateral surface of the inner body and have the configuration of a bearing surface. In view of the application of the liquid exhaust against the lateral surface of the inner body, the base surface of the inner body facing in the direction of the gas flow may be given a rounded form tapering to a point, which is advantageous from a fluid mechanics standpoint. The water drainage line may also have a configuration favoring the flow of exhaust gas. Air resistance coefficients of a deflector hood according to the invention have been reduced to a value of 0.64 or less in a tested embodiment.

BRIEF DESCRIPTION OF THE DRAWING

The invention will become more apparent from a description of an embodiment with reference to the drawing.

DETAILED DESCRIPTION OF THE PREFERRED EMBODIMEMT

Figure 1:
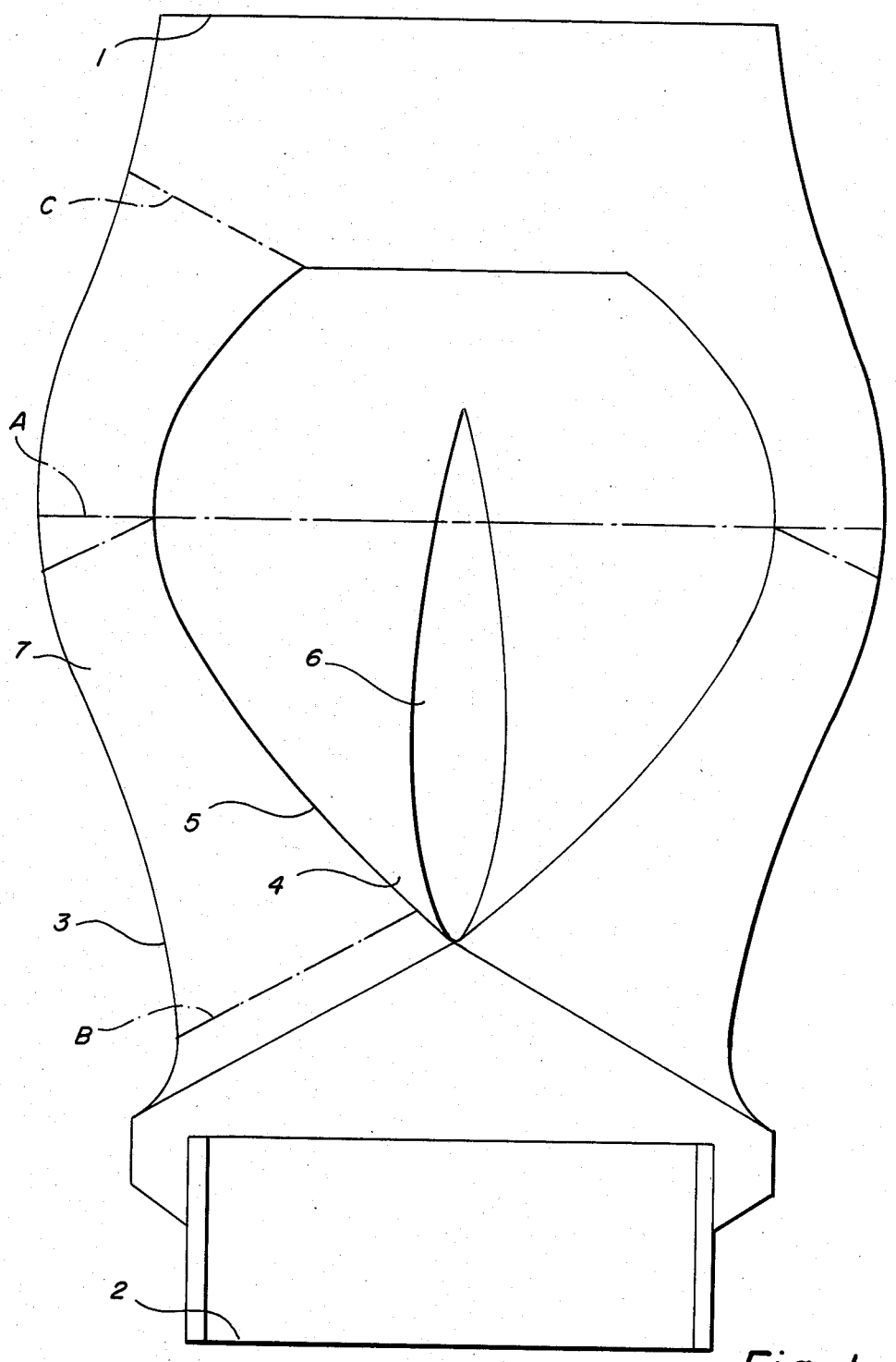
FIG. 1 shows an embodiment of a deflector hood according to the instant invention.

The deflector hood for an air exhaust line of an exhaust installation for digestors as shown in the figure comprises an outer jacket 3 which expands from two opposing openings 1 and 2 to a center plane A located between the openings. The hood acts as a cap on the exhaust line. An inner body 5 is held within the outer jacket 3 and expands continuously from the base 4 of the inner body in the direction of the outlet opening 1. An internal space is open toward the outlet opening and is connected with the environment by a channel 6 which passes through the wall of the outer jacket 3. The inner body 5 has a configuration expanding to the center plane A and subsequently narrowing in the direction of the outlet opening 1, such that the annular space 7 enclosed between the outer jacket 3 and the inner body 5 has a cross-sectional area continuously increasing from the inlet cross-section 2 to the outlet cross-section 1. Assuming for example that the diameter of the inlet cross-section is 194 mm and that its cross-sectional area therefore amounts to 0.0295 $m^2$, the annular channel will have a cross-sectional area of 0.036 $m^2$, in plane B, a cross-section of 0.037 $m^2$ in plane A and a cross-section of 0.040 $m^2$ in plane C. The outlet cross-section 1 is 0.045 $m^2$ for a diameter of 240 mm.

The channel 6 leads from the inside of the inner body through the wall of the outer jacket serving to drain off the rain water captured, originates at the lateral surface and not centeringly from the point of the inner body, as in known configurations of deflector hoods, and has the form of a bearing surface, so that the deflector hood has altogether a shape extraordinarily favorable for flow, thereby offering almost no resistance to the outflowing gases.

Figure 2:
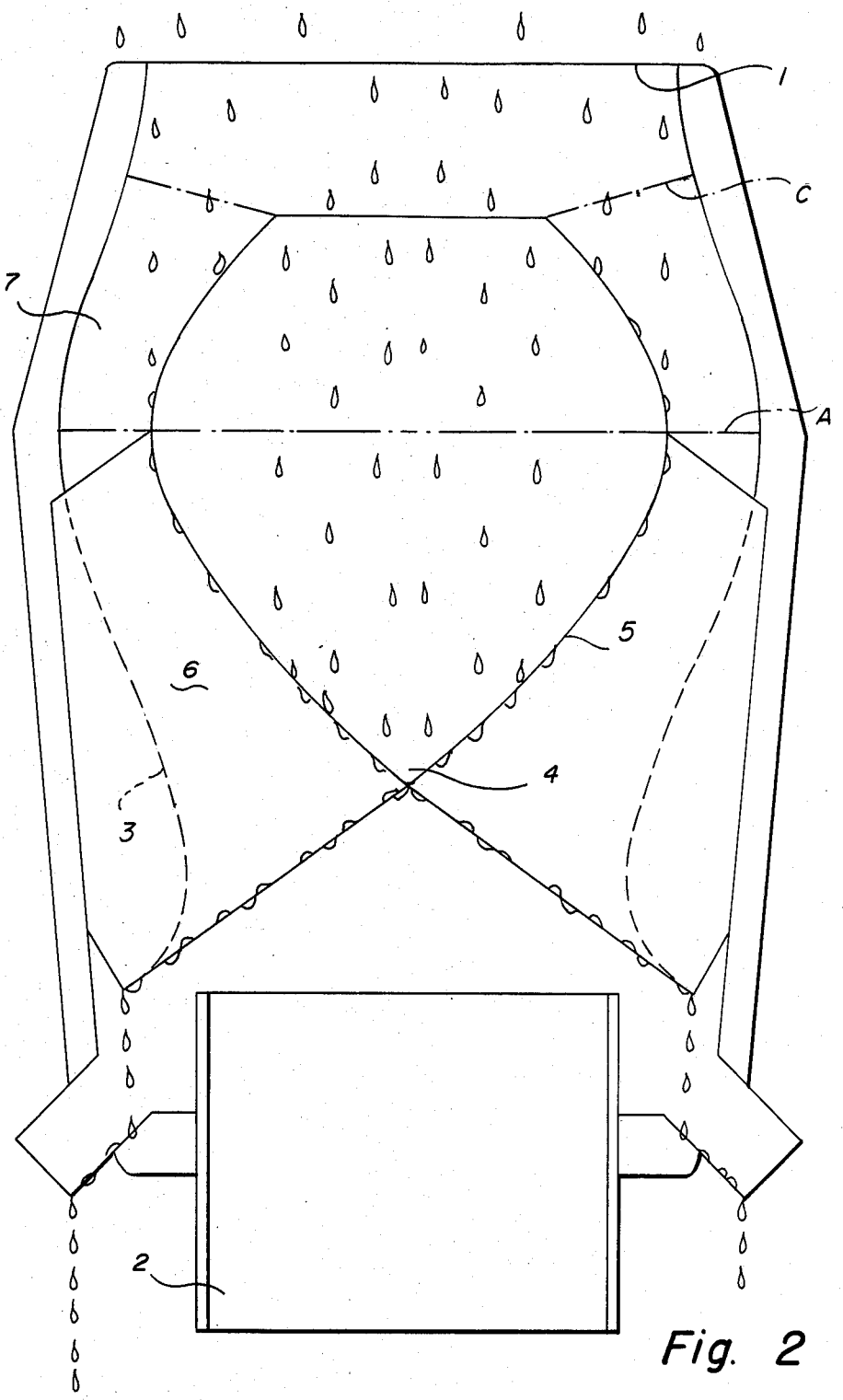
FIG. 2 shows the embodiment of the deflector hood of FIG. 1 rotated by 90°.

FIG. 2 illustrates a deflector hood rotated by 90° in relation to the view shown in FIG. 1. The deflector hood in FIG. 2 illustrates egress of rainwater.

What is claimed is:

1. A chimney deflector hood serving as a cap for an exhaust line comprising:

an outer jacket with an upper and a lower opening, the upper opening being an exhaust outlet and the lower opening being an exhaust inlet, and having an expanding contour from both the upper and lower opening towards a center plane located between said openings;

an inner body held in the outer jacket, having a contour corresponding to the outer jacket which expands from a lower base area of the inner body in an upward direction toward the center plane and narrowing toward an upper outlet opening;

the inner body and the outer jacket define an annular space enclosed between said outer jacket and said inner body having a continuously increasing cross-sectional area from the exhaust inlet to the exhaust outlet;

the inner body having an internal surface open toward the upper outlet opening; and a channel means for fluid drainage, connecting a space within the inner body to an area external to the outer jacket, leading through a wall of said outer jacket.

2. A chimney deflector hood as in claim 1 wherein said channel means originates at a lateral surface of said inner body and is in the form of a bearing surface.

3. A chimney deflector hood as in claim 2 wherein said channel means is contoured so as to minimize resistance to exhaust flow.

4. A chimney deflector hood as in claim 3 wherein the lower base area of the inner body tapers to a point.

* * * * *